US006457491B1

(12) United States Patent
Banba et al.

(10) Patent No.: US 6,457,491 B1
(45) Date of Patent: Oct. 1, 2002

(54) WEFT INSERTING CONTROL DEVICE FOR FLUID JET TYPE LOOM

(75) Inventors: Hideki Banba, Ishikawa; Hiroyuki Kawara, Kanazawa, both of (JP)

(73) Assignee: Tsudakoma Kogyo Kabushiki Kaisha, Ishikawa (JP)

( * ) Notice: Subject to any disclaimer, the term of this patent is extended or adjusted under 35 U.S.C. 154(b) by 0 days.

(21) Appl. No.: 09/934,290

(22) Filed: Aug. 21, 2001

(30) Foreign Application Priority Data

Sep. 7, 2000 (JP) ..... 2000-271914

(51) Int. Cl.[7] ..... D03D 47/28
(52) U.S. Cl. ..... 139/435.2
(58) Field of Search ..... 139/435.2

(56) References Cited

U.S. PATENT DOCUMENTS 4,732,179 A * 3/1988 Takegawa ..... 139/435
4,830,063 A * 5/1989 Takegawa ..... 139/435
5,176,184 A * 1/1993 Yamada ..... 139/435.2

FOREIGN PATENT DOCUMENTS

JP 6-39735 B2 5/1994

* cited by examiner

*Primary Examiner*—Andy Falik
(74) *Attorney, Agent, or Firm*—Frishauf, Holtz, Goodman & Chick, P.C.,

(57) ABSTRACT

A weft inserting control device for a fluid jet type loom for detecting dispersion of a weft reaching angle to control the reaching angle of weft yarn. The device includes a weft insertion detecting unit for detecting dispersion of the weft reaching angle in a plurality of control cycles such as a plurality of picking numbers, for example. The device also includes a controlling unit for comparing a plurality of detection values of the weft reaching angle given by the weft insertion detecting unit with a plurality of respective different reference values, and for controlling the weft reaching angle on the basis of a result of the comparison in every control cycle.

6 Claims, 8 Drawing Sheets

WEFT INSERTING CONTROL DEVICE FOR FLUID JET TYPE LOOM

BACKGROUND OF THE INVENTION

1. Field of the Invention

The present invention relates to a weft inserting control device for a fluid jet type loom for controlling weft reaching timing with relation to a rotation phase of a main shaft of the loom in weft insertion in the fluid jet type loom.

2. Description of the Related Art

Hitherto, in order to converge a dispersion of weft insertion completed timing for a rotation phase of a main shaft of a loom (referred to as weft reaching angle, hereinafter) at a predetermined weft reaching angle, an average deviation, which is an average of difference between an actual reaching angle and an objective reaching angle of weft yarn, has been calculated for every predetermined number of weft insertion times (referred to as picking number, hereinafter). It is arranged that, when the average deviation passes over a predetermined allowable range, fluid jet pressure of a main nozzle or an auxiliary nozzle for weft-inserting be controlled so that the reaching angle would be within the allowable range.

There is also proposed a method for measuring weft inserting power for each weft insertion to accumulate a difference between the weft inserting power and a reference value, and then, controlling the pressure of fluid supplied to a weft inserting nozzle or the rotating number of the main shaft of a loom when the accumulated value passes over an allowable range, as disclosed in a bulletin of Japanese Patent Publication No.39735/1994.

In the case of the former related art described above, however, it is difficult to determine a certain picking number for calculating the average deviation. Excessively large picking number leads to bad response for a rapid change of a weft reaching angle in changing supplied weft where a sort of weft is changed, which sometimes causes a unit to be out of control and stopped. On the contrary, excessively small picking number for calculating the average deviation leads to oversensitive response of a controlling system for a temporary rapid change of the weft reaching time even when the weft reaching angle is almost stable within the reference value, so that the pressure of a weft inserting nozzle would be changed and the reaching angle would not be stable in a converging direction to the contrary, which sometimes causes large dispersion of the reaching angle.

In the case of the latter related art described above, the response for a rapid change of the weft reaching angle can be better in controlling than the former related art described above. It is also difficult, however, as well as the above to determine an allowable range of the accumulated value. Excessively wide allowable range leads to inferior response in controlling similarly to the above, while excessively narrow allowable range leads to oversensitive response also for insignificant deviation of the reaching angle, both of which cause a problem that the reaching angle of weft is not stable. Thus, there have been problems of response and stability in controlling, which are conflicting each other, remaining.

SUMMARY OF THE INVENTION

In view of the above-described problems of the related art, the invention has been made and is aimed to provide a weft inserting control device for a fluid jet type loom in which the response in controlling weft insertion can be improved and whose weft reaching angle can be stabilized, with a simple structure.

The invention provides a weft inserting control device for a fluid jet type loom comprising: a weft insertion detecting unit for detecting dispersion of a weft reaching angle in a plurality of control cycles; and a controlling unit for comparing a plurality of detection values of the weft reaching angle given by the weft insertion detecting unit with a plurality of respective different reference values, and for controlling the weft reaching angle based on a result of the comparison in every control cycle.

The reference values are set so as to have a minus correlation with a length of the respective control cycles. And the detection value is at least one deviation from the reference values of the weft reaching angle in the respective control cycles or is an average value of the deviation.

The controlling unit for the weft reaching angle controls supplied fluid pressure of the weft inserting nozzle, the timing of weft insertion, the rotation number of a main shaft of a loom or such in accordance with fuzzy reasoning corresponding to the above detection value. The weft reaching angle is controlled on the basis of the detection value in the shorter control cycle among the control cycles in which the detection value over the reference value is obtained, when the detection value in a plurality of control cycles is respectively over the reference value. dr

DESCRIPTION OF THE PREFERRED EMBODIMENTS

Figure 1:
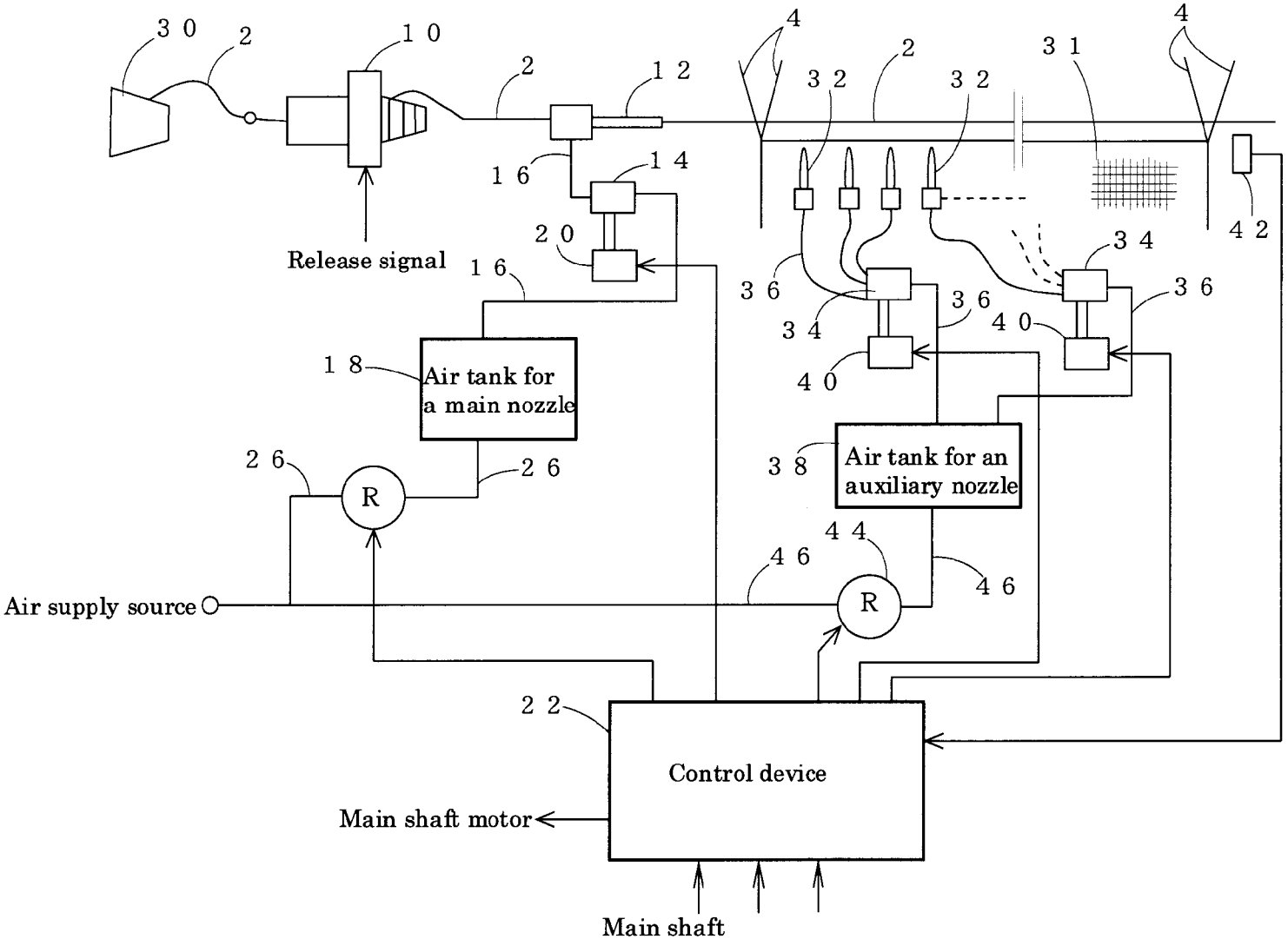
FIG. 1 is a schematic view of a weft inserting control device for fluid jet type loom according to the first embodiment of the invention.

An embodiment of the invention will be described hereinafter on the basis of the drawings. FIG. 1 is a weft inserting control device according to a first embodiment of the invention, which comprises a measuring and storing device provided on a loom stand not shown in the drawings and a main nozzle 12, which is a weft inserting nozzle for transporting weft yarn 2 by means of air jet. The main nozzle 12 is connected with a tube path 16 provided in its middle part with a valve mechanism 14. A base end portion of the tube path 16 is connected to an air tank 18 for the main nozzle. The valve mechanism 14 is provided with an electromagnetic driving portion 20 such as a electromagnetic valve, which is connected to a control device 22 to be controlled. The air tank 18 for the main nozzle is connected to an air supplying source by a tube path 26 via an electropneumatic regulator 24, which is connected to the control device 22 to be controlled. The loom stand is also provided with a thread feeding body 30 for feeding the weft yarn 2 so that the weft yarn 2 fed from the thread feeding body 30 would be weft-inserted through the main nozzle 12.

A plurality of auxiliary nozzles 32, which are weft inserting nozzles, are positioned along a path for weft-inserting the weft yarn 2 in the vicinity of a weaving front of a cloth 31, which has been weft-inserted. Each auxiliary nozzle 32 is connected with each tube path 36 provided in its middle part with a plurality of valve mechanisms 34, similar to the main nozzle 12. A base end portion of each tube path 36 is connected to an air tank 38 for the auxiliary nozzle. Each valve mechanism 34 is provided with an electromagnetic driving portion 40, each of which is connected to the control device 22 to be controlled. The air tank 38 for an auxiliary nozzle is connected to an air supplying source by a tube path 46 via an electropneumatic regulator 44, which is connected to the control device 22 to be controlled.

A weft detecting device 42, which is a weft insertion detecting unit, is provided on an anti-weft inserting side (on a side symmetrically contrary to the weft inserting nozzle with respect to the cloth) at the point preceding to the cloth 31 that the weft yarn 2 passes through. Output of the weft detecting device 42 is inputted to the control device 22. Further, such as rotary encoder not shown in the drawings detects and inputs to the control device 22 information such as rotation number and rotation phase of a main shaft of a loom not shown. Such information is converted into digital data and inputted to the control device 22 so as to be used for a predetermined calculation.

Next, an operation of the weft inserting control device for fluid jet type loom according to this embodiment will be described. First, when the loom is operated to carry out weft insertion, the weft yarn 2, which was fed from the thread supplying body 30 and stored in the measuring and storing device 10 for a predetermined period, is jetted from the main nozzle 12 together with jet fluid such as air so as to be weft-inserted in an opening of warp yarn 4. The weft-inserted weft yarn 2 is detected at its end by the weft detecting device 42 provided on the anti-weft insertion side, so that the weft insertion would be completed. In weft-inserting, each auxiliary nozzle 32 assists transportation of the weft yarn 2 so as to rapidly weft-insert the weft yarn 2 at a predetermined position. The air jet of the main nozzle 12 and the auxiliary nozzle 32 is carried out at timing corresponding to a predetermined rotation phase of the main shaft of a loom by opening and closing the air jet control valve not shown of the valve mechanisms 14 and 34 in accordance with a signal from the control device 22 into which information of a rotation angle of the main shaft of a loom has been inputted.

Figure 2:
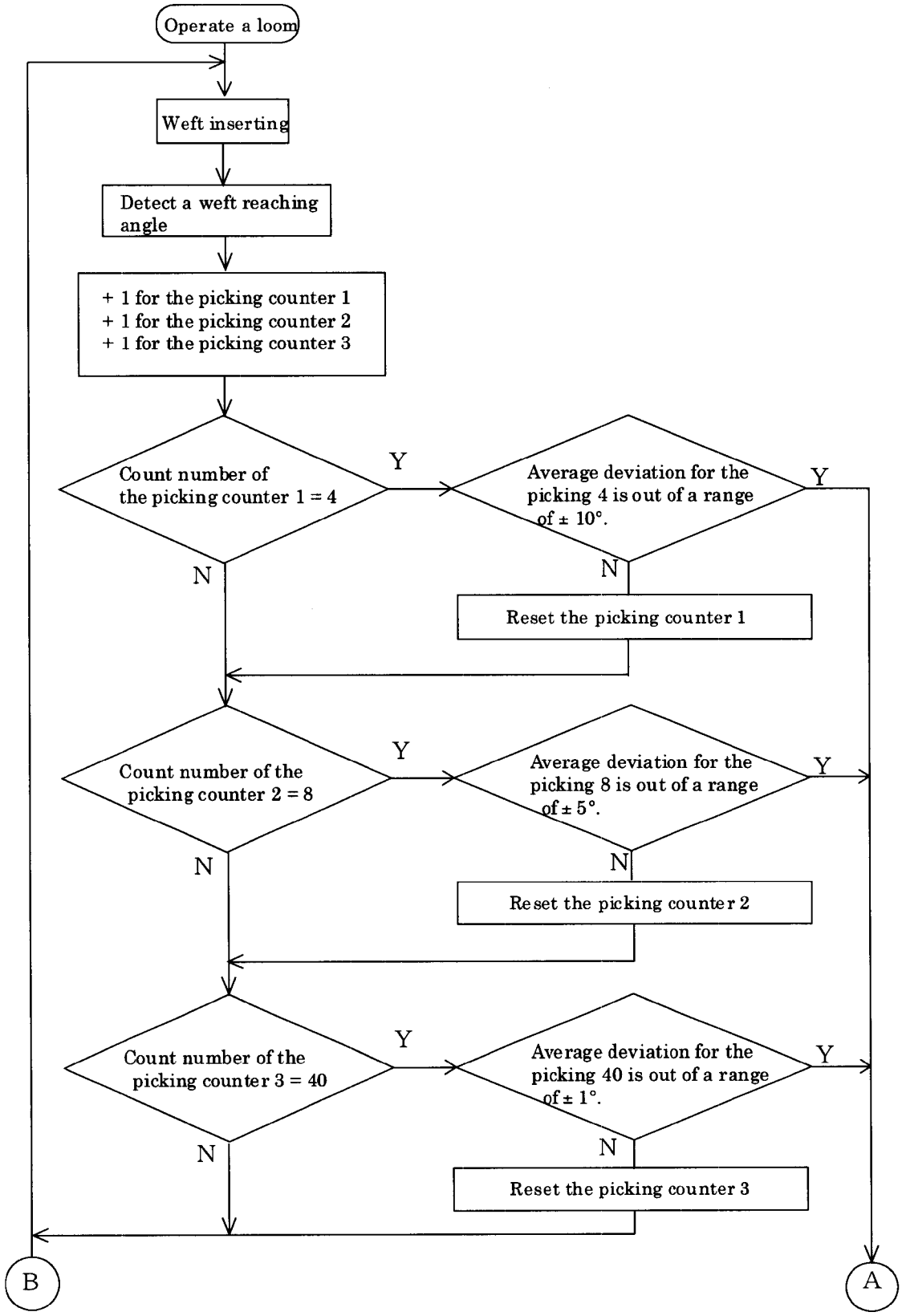
FIG. 2 is a flowchart showing a controlling method of the weft inserting control device according to the embodiment of the invention.
Figure 3:
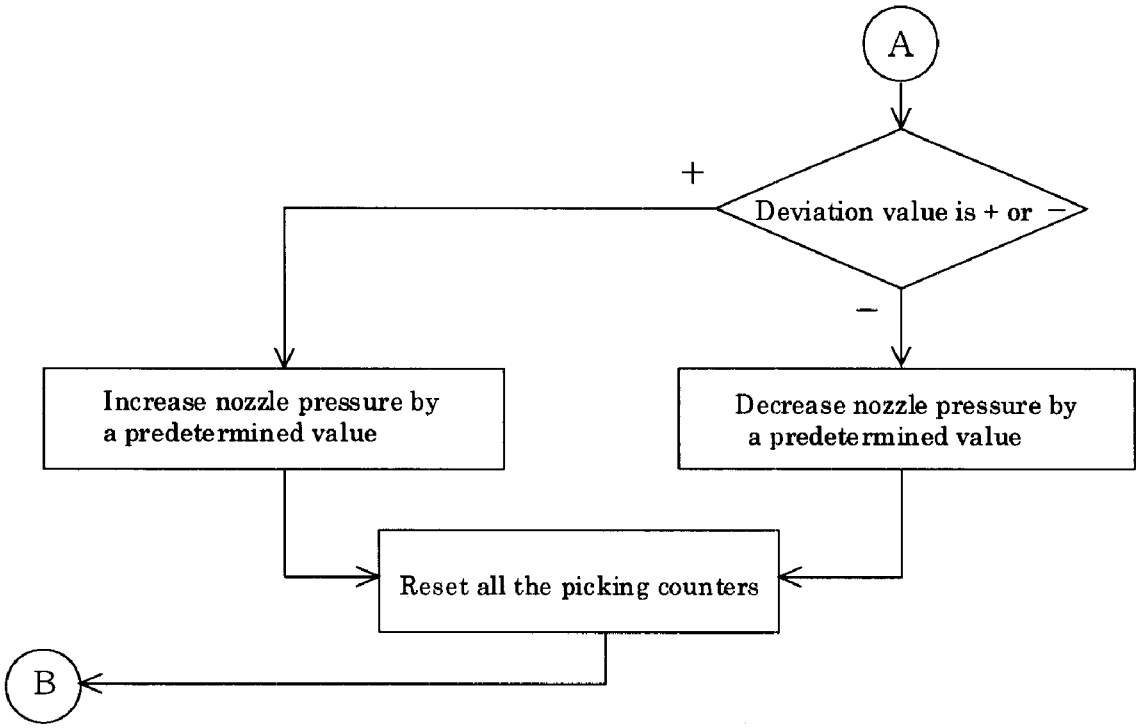
FIG. 3 is a flowchart showing a method for controlling nozzle pressure and continued from the flowchart shown in FIG. 2.

The weft reaching angle in weft insertion is controlled by such as a microcomputer in the control device 22. First, the control device 22 detects as a weft reaching angle a rotation phase of a main shaft of a loom at the time when the weft detecting device 42 detects an end of the weft yarn, as shown in FIGS. 2 and 3. Then, an average value of deviation of an actual reaching angle for an objective reaching angle is obtained in every predetermined picking number, which is a predetermined control cycle. In this embodiment, the predetermined picking number is the following three kinds: picking number 4, 8, and 40, in each control cycle of which carried out the weft inserting control.

The reference value, which is an allowable value of average deviation in a control cycle for every picking number, is set to be at maximum ±10° of average deviation of the objective reaching angle in the picking cycle 4, ±5° in the picking cycle 8, and ±1° in the picking cycle 40. In the case that each average deviation in each control cycle is over the above reference value, when the deviation value is on the + side (on the delaying side in reaching) with respect to its objective reaching angle, the control device 22 controls electromagnetic driving portions 20 and 40 of the respective valve mechanisms 14 and 34 so that the air jet pressure of the main nozzle 12 and the auxiliary nozzle 32 would be increased by a predetermined value. On the contrary, when the deviation value is on the − side (on the accelerating side in reaching) with respect to its objective reaching angle, the control device 22 controls electromagnetic driving portions 20 and 40 of the respective valve mechanisms 14 and 34 as well as the above so that the air jet pressure of the main nozzle 12 and the auxiliary nozzle 32 would be decreased by a predetermined value.

The controlling amount of the weft reaching angle in controlling weft insertion is set in accordance with fuzzy reasoning on the basis of fluctuated amount of the air jet pressure of respective nozzles 12 and 32 so as to correspond to the average detection value, which is the detection value. As for other concrete control for the weft insertion, the timing for weft-inserting or the rotation number of a main shaft of a loom may be controlled.

Figure 4:
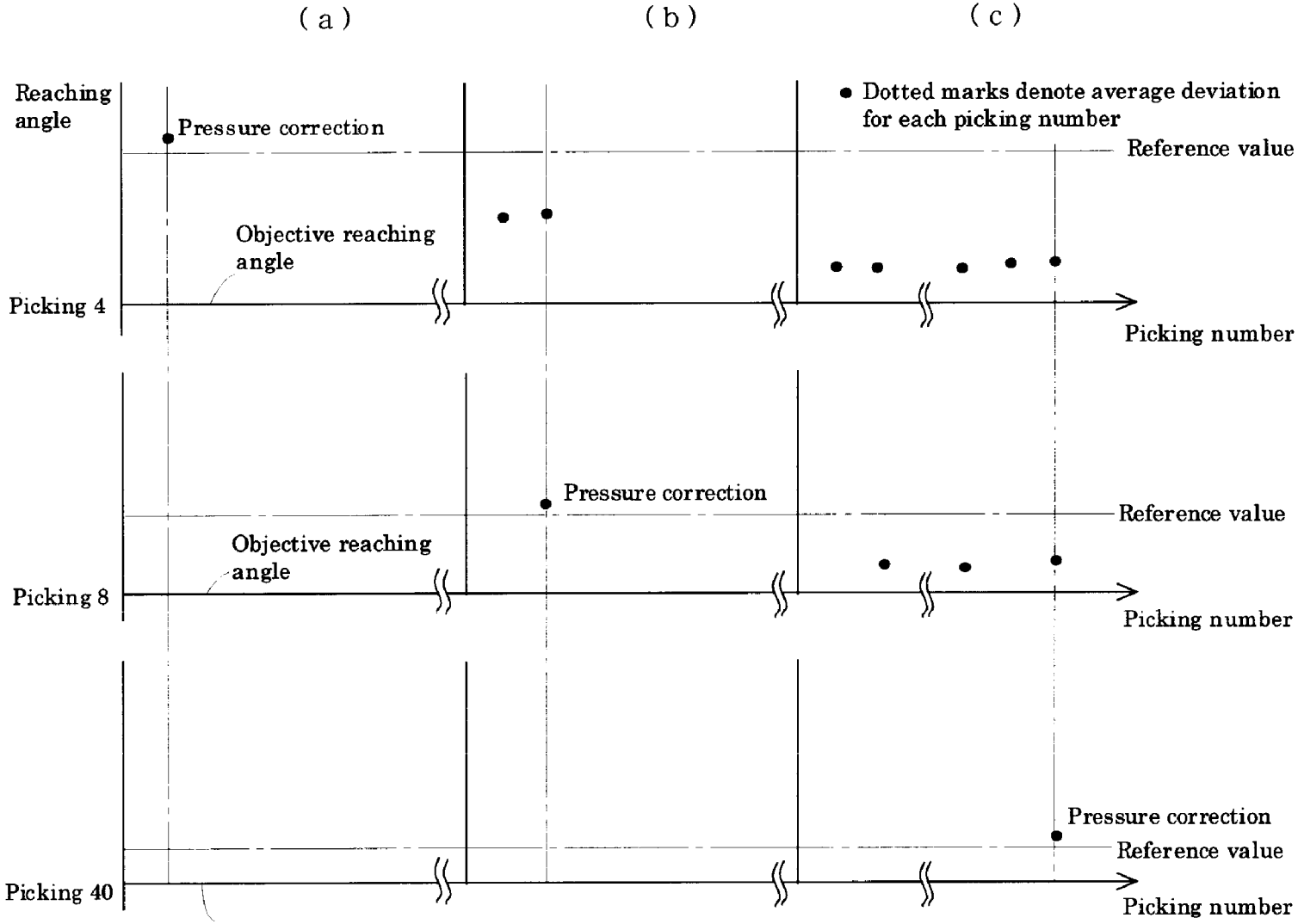
FIG. 4 is a graph showing a controlling method of the weft inserting control device according to the embodiment of the invention.

This control is carried out by the control device 22 for every predetermined picking number, which is each control cycle. For example, as shown in FIG. 4(*a*) as an example, when the average deviation is over the reference value of the allowable range in the picking cycle 4, the control device 22 controls the air jet pressure of the main nozzle 12 and the auxiliary nozzle 32 to be decreased. Under a condition shown in FIG. 4(*b*), the average deviation for the picking cycle 4 is smaller than the reference value, while the average deviation for the picking cycle 8 in which the reference value is set at 5° is over the reference value, so that the pressure of the main nozzle 12 and the auxiliary nozzle 32 is also controlled in this case. Further, as shown in FIG. 4(*c*), in the case of a control cycle for the picking cycle 40 in which an even lower reference value is set, when the average deviation in the picking cycle 40 is over 1°, even if the average deviation in another control cycle is not over the predetermined reference value, weft inserting control such as adjustment of jet air pressure is carried out.

Figure 5:
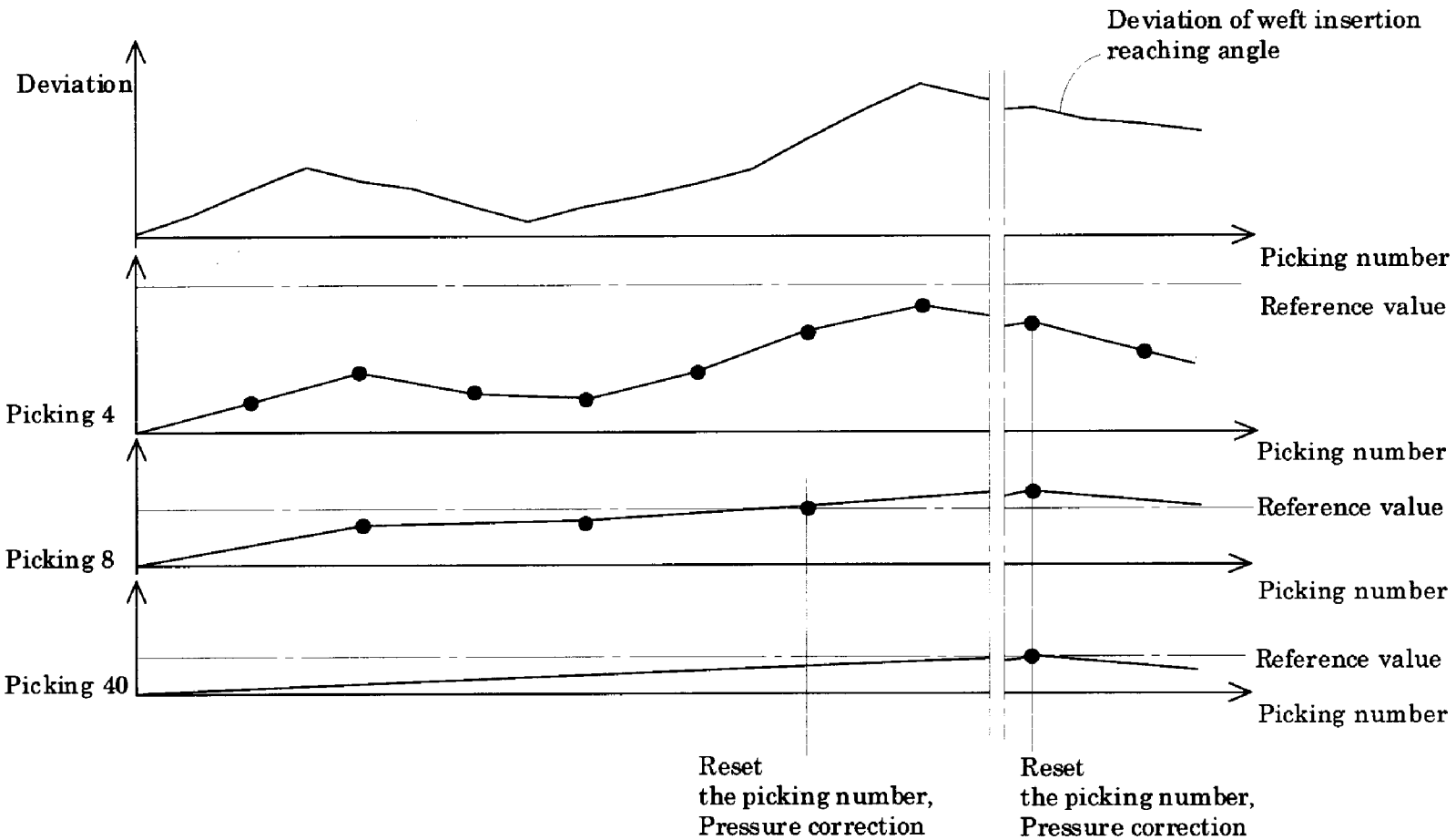
FIG. 5 is another graph showing a controlling method of the weft inserting control device according to the embodiment of the invention.

Weft inserting control in each control cycle is performed separately. When the average deviation in a plurality of control cycles is over respective reference values at the same time, a controlling amount is set in accordance with fuzzy reasoning on the basis of the average deviation in the shorter control cycle among the control cycles over the reference value. When the average deviation in one of a plurality of control cycles is over a predetermined reference value, as shown in FIG. 5, a count of picking in each control cycle is reset once and re-count from the first picking is carried out in each control cycle so that the control would be performed as described above.

In the weft inserting control device for fluid jet type loom according to the embodiment, an reference value is set so that the average deviation in the three kinds of control cycles, the picking numbers 4, 8, and 40, would be a predetermined allowable range different in every control cycle and so that the reference value would be decreased for the length of a control cycle to 10°, 5°, and 1° in order, and the control cycle and the reference value are set to have a minus correlation. Accordingly, a response in controlling to a rapid change in the weft reaching angle would be good in a short control cycle, while precise control can be achieved for a gradual change, so that stable control would be possible.

Figure 6:
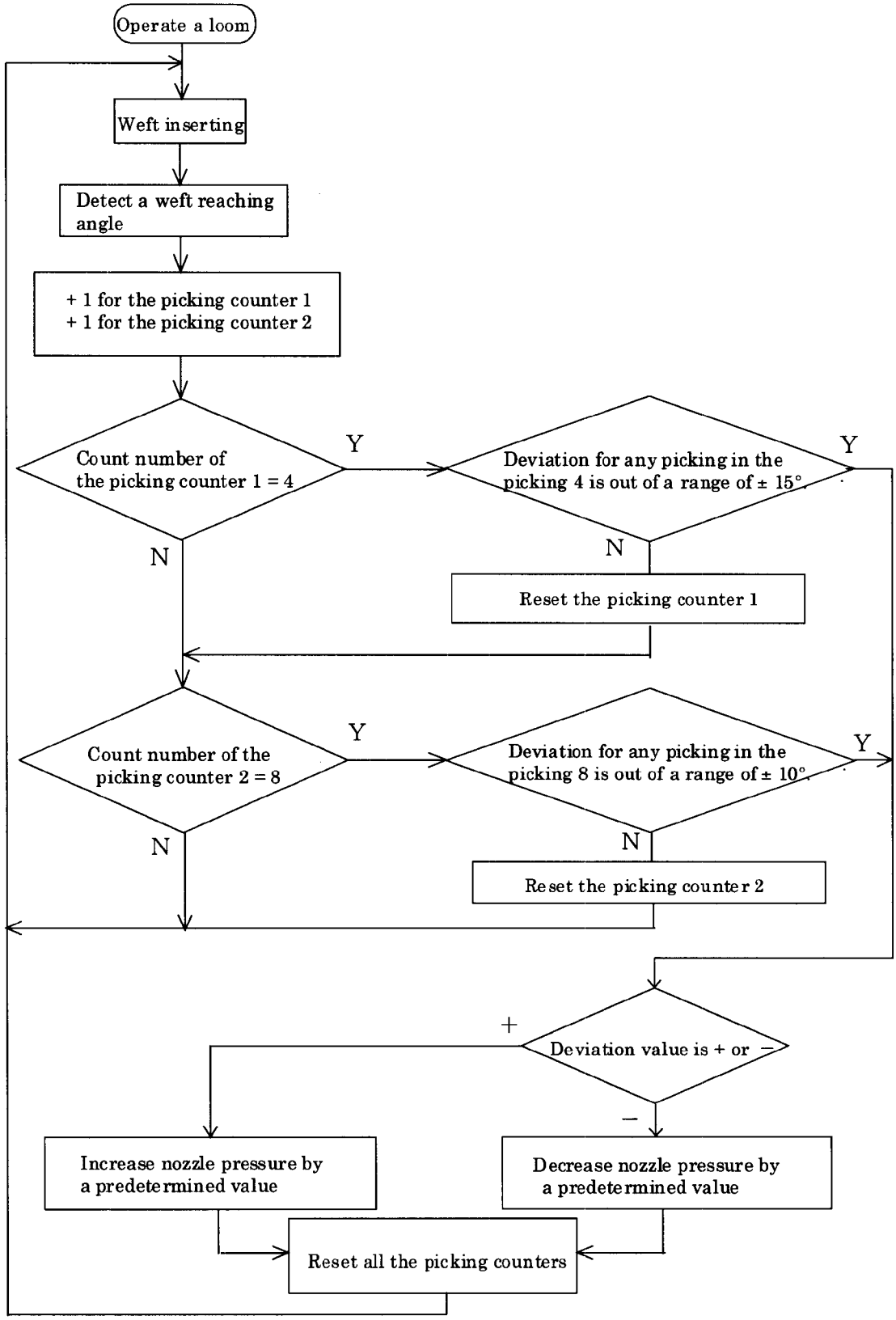
FIG. 6 is a flowchart showing a controlling method of the weft inserting control device according to the second embodiment of the invention.

Next, the second embodiment of the invention will be described on the basis of FIG. 6. In this embodiment, weft inserting control is carried out in a control cycle comprising two kinds of picking number, 4 and 8. Pressure of respective nozzles 12 and 32 is controlled as well as the above-described embodiment when deviation of the weft inserting reaching angle for any picking is 15° or more in the picking cycle 4 and when deviation of the weft inserting reaching angle of any picking is 10° or more in the picking cycle 8. Other than the above, it is also possible to control the weft inserting timing and the rotation number of a main shaft of a loom.

In this embodiment, pressure of respective nozzles 12 and 32, for example, is controlled when the deviation of the weft reaching angle passes over even once a predetermined reference value for any picking number in each of a predetermined plurality of control cycles, so that accurate and stable control would be possible in an even simpler structure.

Figure 7:
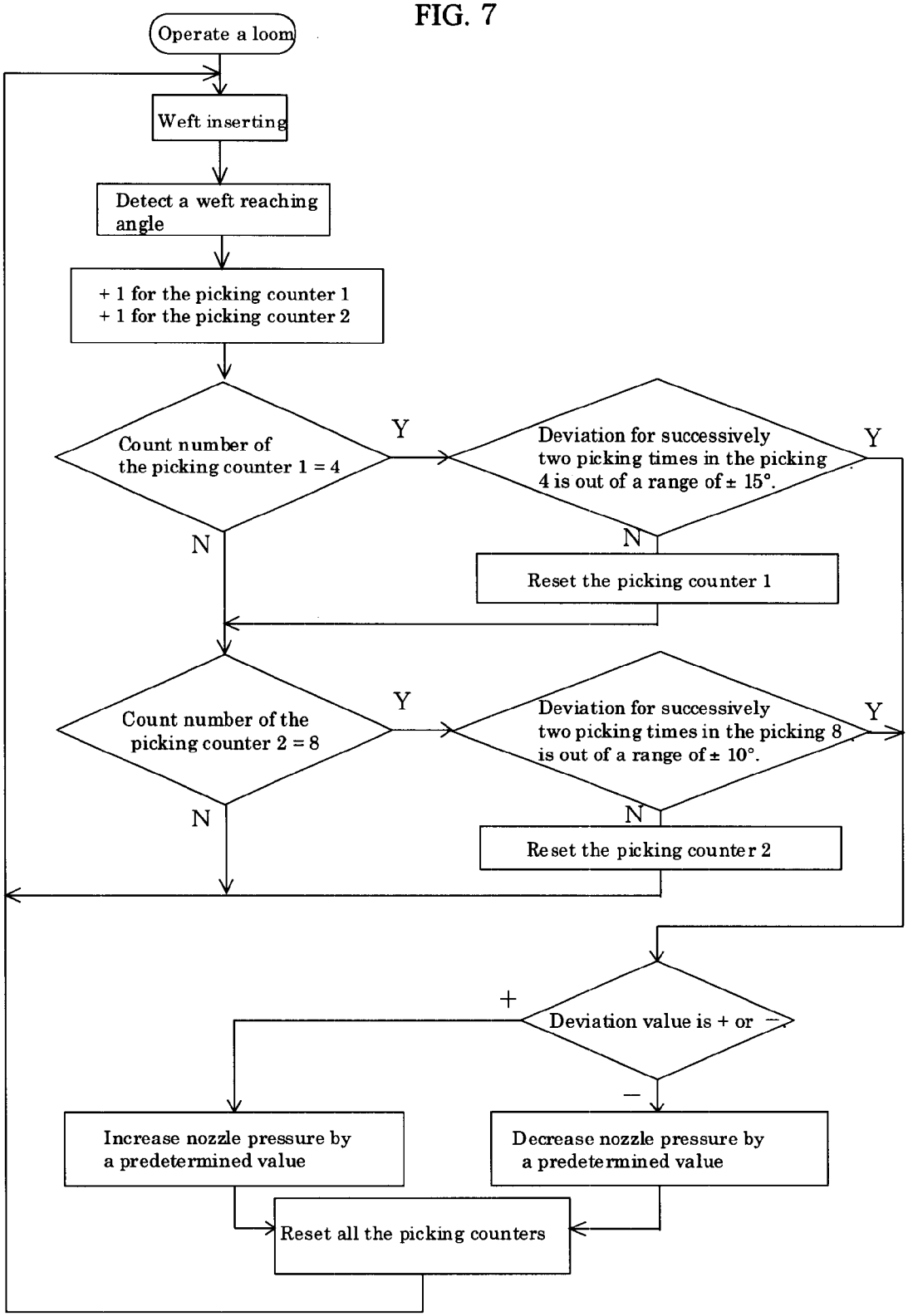
FIG. 7 is a flowchart showing a controlling method of the weft inserting control device according to the third embodiment of the invention.

Next, the third embodiment of the invention will be described on the basis of FIG. 7. In this embodiment, weft inserting control is carried out in a control cycle comprising two kinds of picking number, 4 and 8. Pressure of respective nozzles 12 and 32 is controlled as well as the above-described embodiment when deviation of the weft inserting reaching angle is 15° or more for successively two picking times in the picking cycle 4 and when deviation of the weft inserting reaching angle is 10° or more for successively two picking times in the picking cycle 8. The number of successive picking times can be set at any time properly in this case. It is also possible to control the weft inserting timing and the rotation number of a main shaft of a loom other than the above.

In this embodiment, pressure of respective nozzles 12 and 32, for example, is controlled when the deviation of the weft reaching angle passes over a predetermined reference value for successively two picking times in each of a predetermined plurality of control cycles, so that more certain control would be possible.

Figure 8:
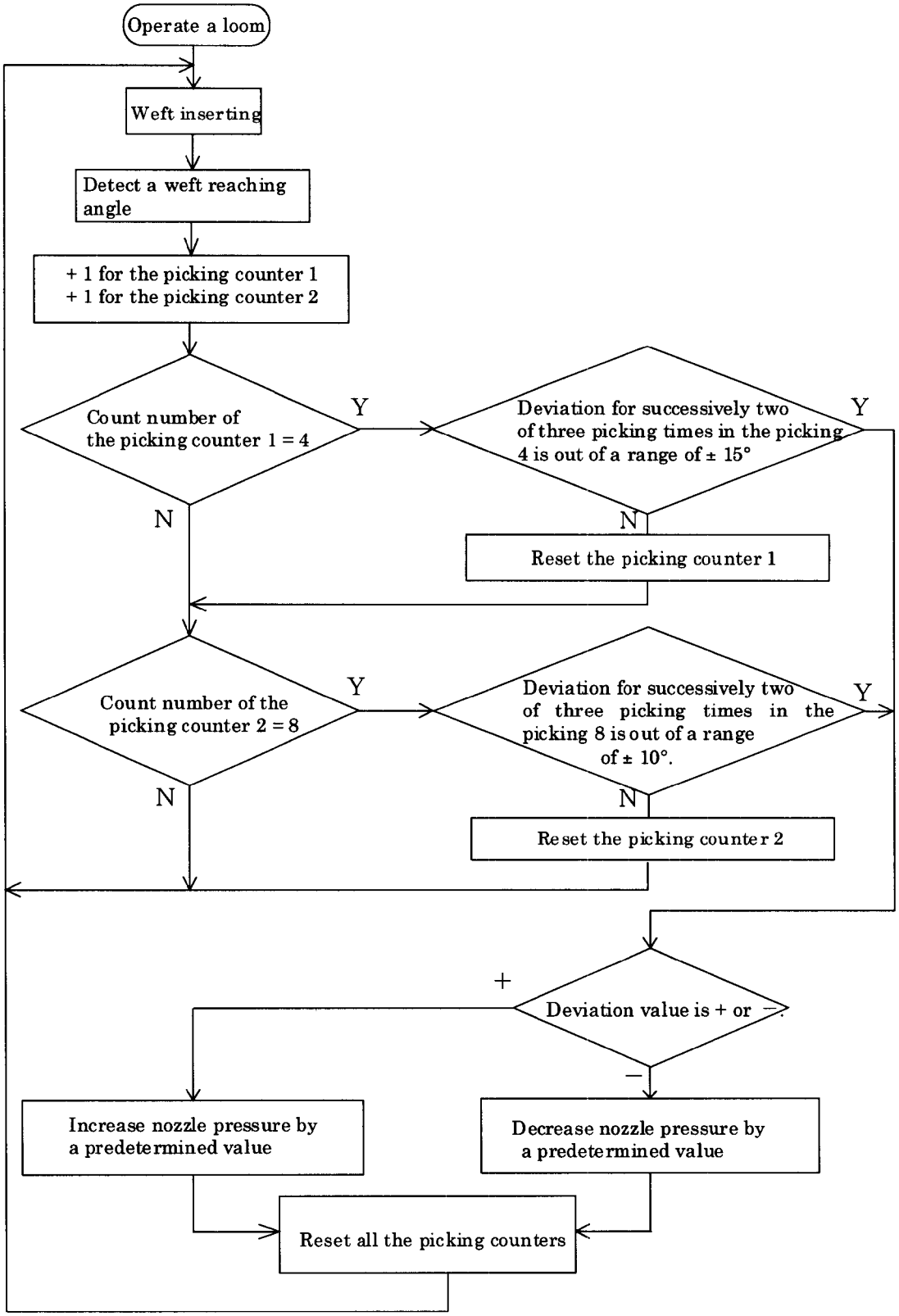
FIG. 8 is a flowchart showing a controlling method of the weft inserting control device according to the fourth embodiment of the invention.

Next, the fourth embodiment of the invention will be described on the basis of FIG. 8. In this embodiment, weft inserting control is carried out in a control cycle comprising two kinds of picking number, 4 and 8. Pressure of respective nozzles 12 and 32 is controlled as well as the above-described embodiments when deviation of the weft inserting reaching angle is 15° or more for successively two picking times among three in the picking cycle 4 and when deviation of the weft inserting reaching angle is 10° or more for successively two picking times among three in the picking cycle 8. The number of successive picking times in each control cycle can be set at any time properly in this case. It is also possible to control the weft inserting timing and the rotation number of a main shaft of a loom other than the above.

In this embodiment, set a case that the deviation of the weft inserting reaching angle is over a reference value for a predetermined picking number during a predetermined period in each of a predetermined plurality of control cycles, so that more certain control would be possible.

The weft inserting control device for fluid jet type loom according to the invention is not limited to the above embodiment. The sort and period of a plurality of control cycles are set at any time properly. The controlling amount can be also set at any time properly on the basis of the deviation value other than the fuzzy reasoning. It is also possible to properly combine controlling methods in the respective embodiments described above.

The weft inserting control device for fluid jet type loom according to the invention can accurately and certainly correspond to a rapid change as well as a gradually appearing small amount of change in the weft reaching angle with a good response, so that stable control can be performed. Especially, it is arranged that the control cycle and the reference value be set to have a minus correlation, which leads to high response and accurate control available for even a slight change. Furthermore, appropriate control would be easily possible by setting the controlling amount in accordance with the fuzzy reasoning.

What is claimed is:

1. A weft inserting control device for a fluid jet type loom comprising:

a weft insertion detecting unit for detecting dispersion of a weft reaching angle in a plurality of control cycles;

a controlling unit for comparing a plurality of detection values of the weft reaching angle given by the weft insertion detecting unit with a plurality of respective different reference values, and for controlling the weft reaching angle based on a result of the comparison in every control cycle.

2. The weft inserting control device according to claim 1, wherein the controlling unit includes means for setting the reference values to have a minus correlation with a length of the respective control cycles.

3. The weft inserting control device according to claim 2, wherein the controlling unit includes means for calculating an average value of deviation of the weft reaching angle in the respective control cycles.

4. The weft inserting control device according to claim 2, wherein the controlling unit includes means for calculating at least one deviation from the reference values of the weft reaching angle in the respective control cycles.

5. The weft inserting control device according to claim 2, wherein the controlling unit weft insertion in accordance with fuzzy reasoning in response to a deviation amount of the weft reaching angle.

6. The weft inserting control device according to claim 2, wherein when the detection values in a plurality of the control cycles are respectively over the reference values, the controlling unit includes means for controlling the weft reaching angle based on the detection value in a shorter one of the control cycles in which the detection values are over the respective reference values.

* * * * *